US005284490A

United States Patent [19]

Green

[11] Patent Number: 5,284,490

[45] Date of Patent: Feb. 8, 1994

[54] INFANT TEETHING ARRANGEMENT

[76] Inventor: Alicia J. Green, 308 Gina Dr., Carson, Calif. 90745

[21] Appl. No.: 999,266

[22] Filed: Dec. 31, 1992

[51] Int. Cl.[5] ..... A61J 17/00

[52] U.S. Cl. ..... 606/235; 606/234; D24/194

[58] Field of Search ..... 606/234–235, 606/236; D24/194–198

[56] References Cited

U.S. PATENT DOCUMENTS

| | | | |
|---|---|---|---|
| D. 288,126 | 2/1987 | Haupt | D24/195 |
| 462,763 | 11/1891 | Grabler | 606/235 |
| 745,920 | 12/1903 | Spencer | 606/236 |
| 1,194,246 | 8/1916 | Shambaugh | 606/235 |
| 2,889,829 | 6/1959 | Tannenbaum et al. | 606/236 |
| 3,669,117 | 6/1972 | Herbst | 606/235 |
| 5,013,321 | 5/1991 | MacVane | 606/234 |
| 5,160,344 | 11/1992 | Werton | 606/234 |

*Primary Examiner*—Stephen C. Pellegrino
*Assistant Examiner*—Glenn Dawson
*Attorney, Agent, or Firm*—Leon Gilden

[57] ABSTRACT

An infant teething arrangement includes a multi-ended teething construction having a first teething member and a second teething member mounted to respective first and second ends of a handle, with the first teething member including intersecting first and second resilient plates longitudinally aligned with the handle, having an abutment flange to prevent over-penetration of the first teething member into an infant's mouth, with the second teething member formed of a cylindrical like construction having resilient exercise projections mounted to the top and bottom walls of the second teething member.

5 Claims, 4 Drawing Sheets

INFANT TEETHING ARRANGEMENT

BACKGROUND OF THE INVENTION

1. Field of the Invention

The field of invention relates to teething apparatus, and more particularly pertains to a new and improved infant teething arrangement wherein the same is arranged to provide for a plurality of soothing teething components for use by an infant.

2. Description of the Prior Art

Teething structure of various types have been utilized in the prior art to assist in the exercise and soothing of an infant during the teething process, wherein such patents are exemplified by U.S. Pat. No. 4,311,149; 3,653,386; and 4,577,632.

The instant invention attempts to overcome deficiencies of the prior art by providing for a convenient and readily employed structure for use by an infant incorporating both safety and effectiveness in the soothing of an infant's gums in use and in this respect, the present invention substantially fulfills this need.

SUMMARY OF THE INVENTION

In view of the foregoing disadvantages inherent in the known types of teething apparatus now present in the prior art, the present invention provides an infant teething arrangement wherein the same employs a multi-ended teething structure for grasping manipulation by an infant. As such, the general purpose of the present invention, which will be described subsequently in greater detail, is to provide a new and improved infant teething arrangement which has all the advantages of the prior art teething apparatus and none of the disadvantages.

To attain this, the present invention provides an infant teething arrangement including a multi-ended teething construction having a first teething member and a second teething member mounted to respective first and second ends of a handle, with the first teething member including intersecting first and second resilient plates longitudinally aligned with the handle, having an abutment flange to prevent over-penetration of the first teething member into an infant's mouth, with the second teething member formed of a cylindrical like construction having resilient exercise projections mounted to the top and bottom walls of the second teething member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant teething arrangement which has all the advantages of the prior art teething apparatus and none of the disadvantages.

It is another object of the present invention to provide a new and improved infant teething arrangement which may be easily and efficiently manufactured and marketed.

It is a further object of the present invention to provide a new and improved infant teething arrangement which is of a durable and reliable construction.

An even further object of the present invention is to provide a new and improved infant teething arrangement which is susceptible of a low cast of manufacture with regard to both materials and labor, and which accordingly is then susceptible of low prices of sale to the consuming public, thereby making such infant teething arrangements economically available to the buying public.

Still yet another object of the present invention is to provide a new and improved infant teething arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
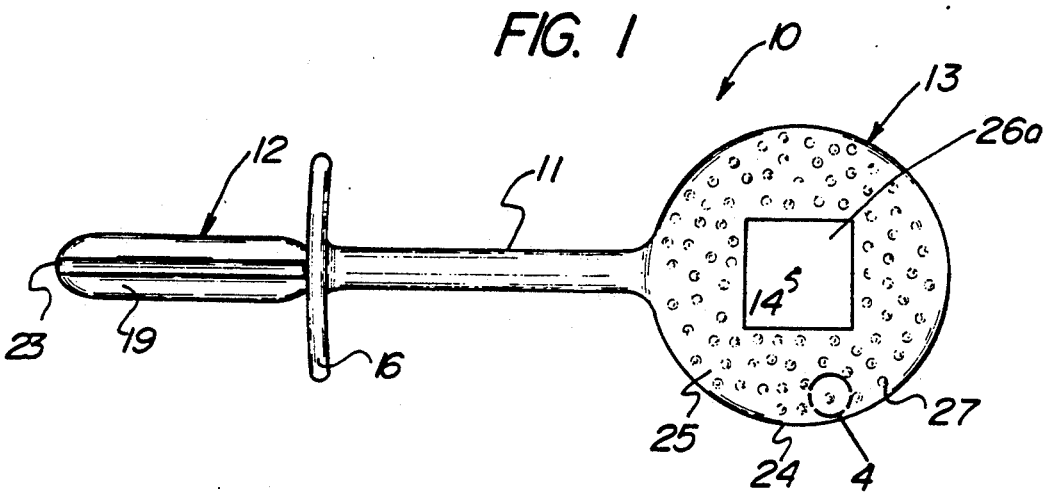
FIG. 1 is an orthographic top view of the invention.
Figure 2:
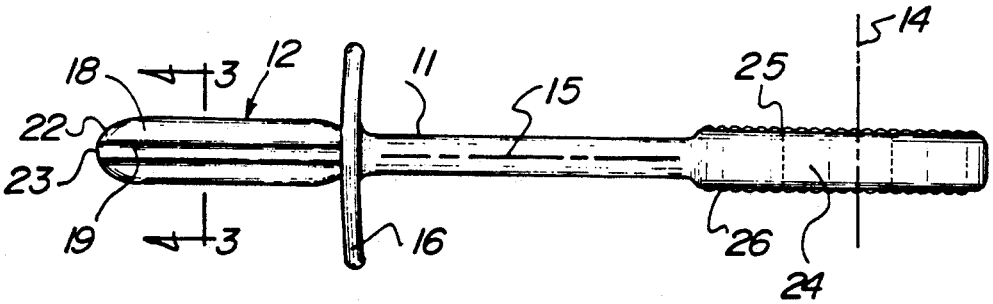
FIG. 2 is an orthographic side view of the invention.
Figure 3:
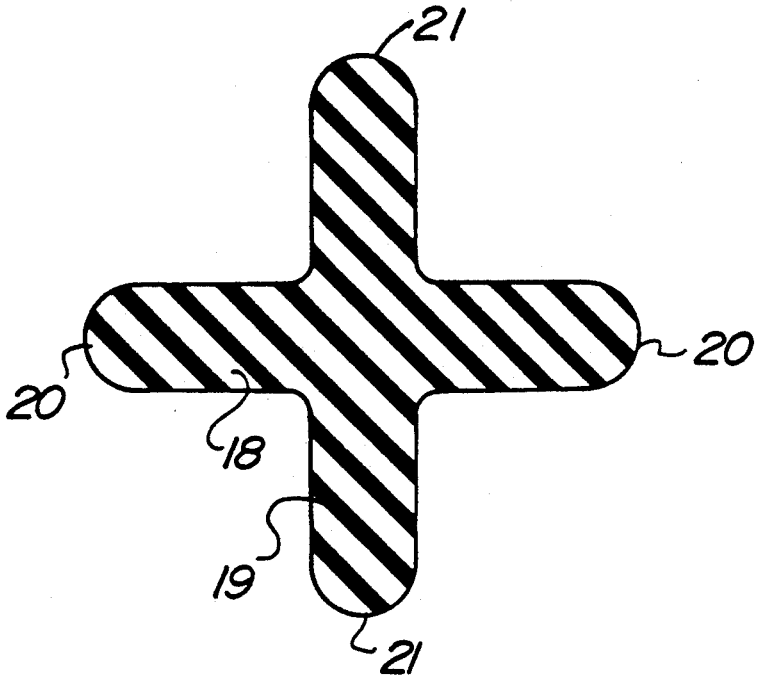
FIG. 3 is an orthographic view, taken along the lines 3—3 of FIG. 2 in the direction indicated by the arrows.
Figure 4:
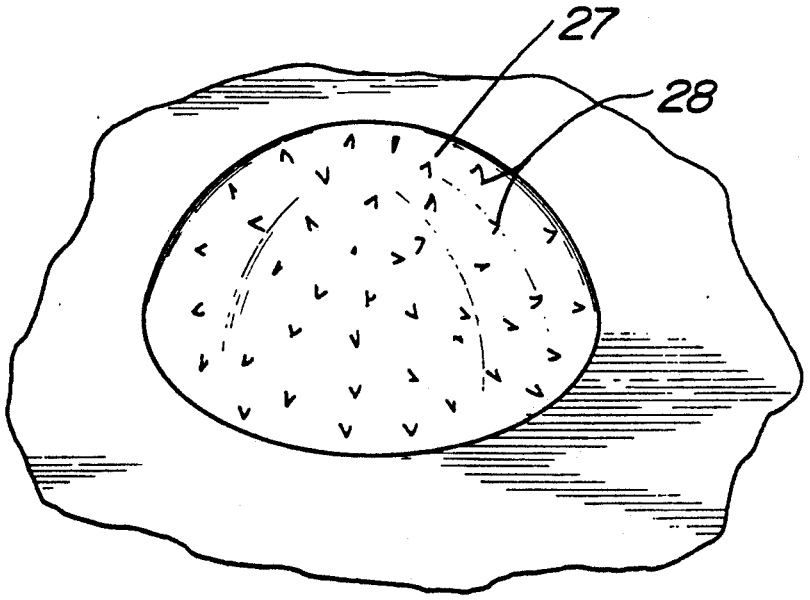
FIG. 4 is an enlarged isometric illustration of section 4 as set forth in FIG. 1.
Figure 5:
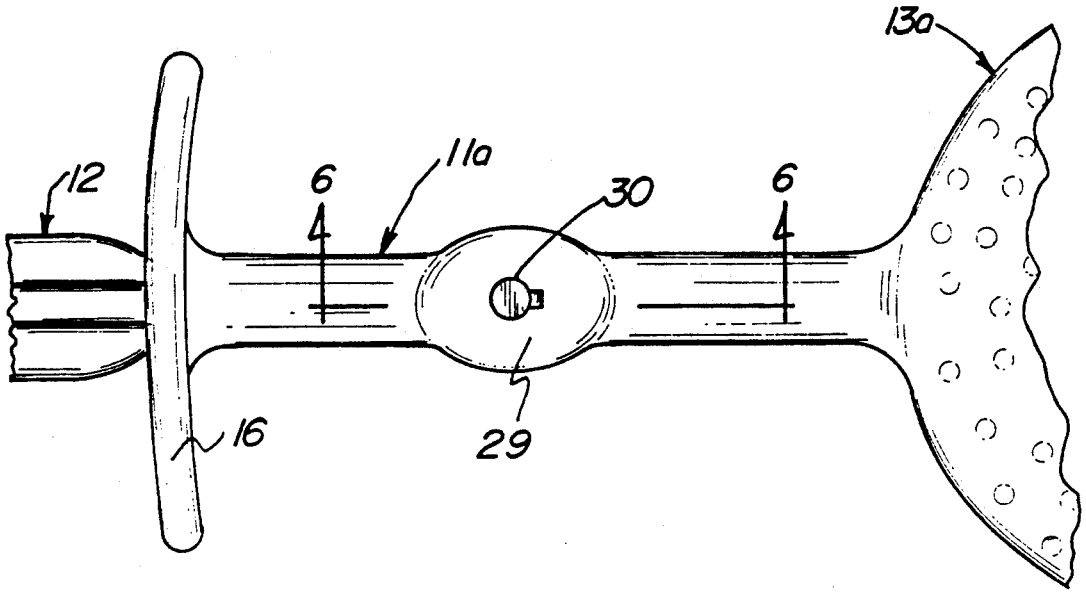
FIG. 5 is an orthographic view of a modified handle structure of the invention for cooperation with a modified second teething member.
Figure 6:
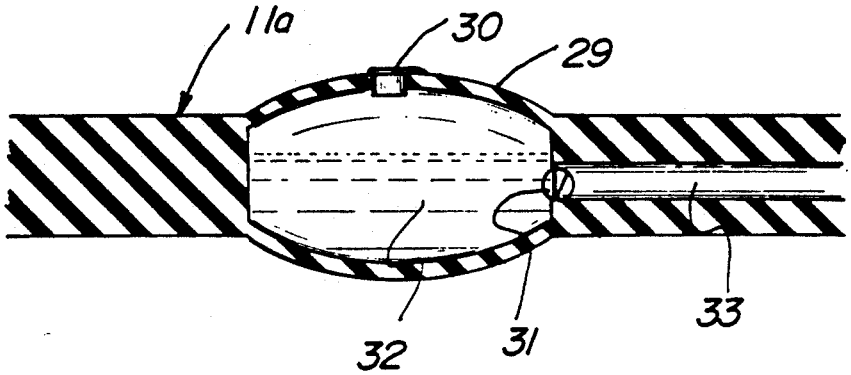
FIG. 6 is an orthographic view, taken along the lines 6—6 of FIG. 5 in the direction indicated by the arrows.
Figure 7:
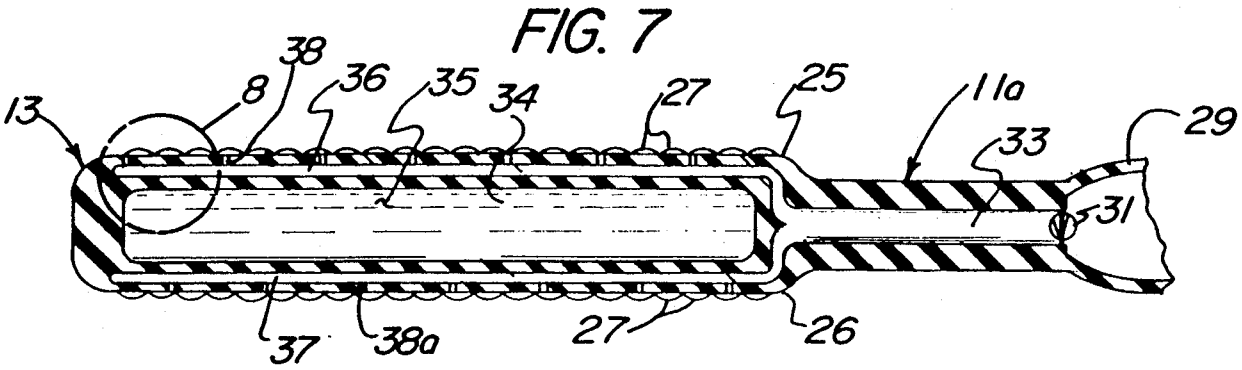
FIG. 7 is an orthographic cross-sectional illustration of the modified second teething member of the invention.
Figure 8:
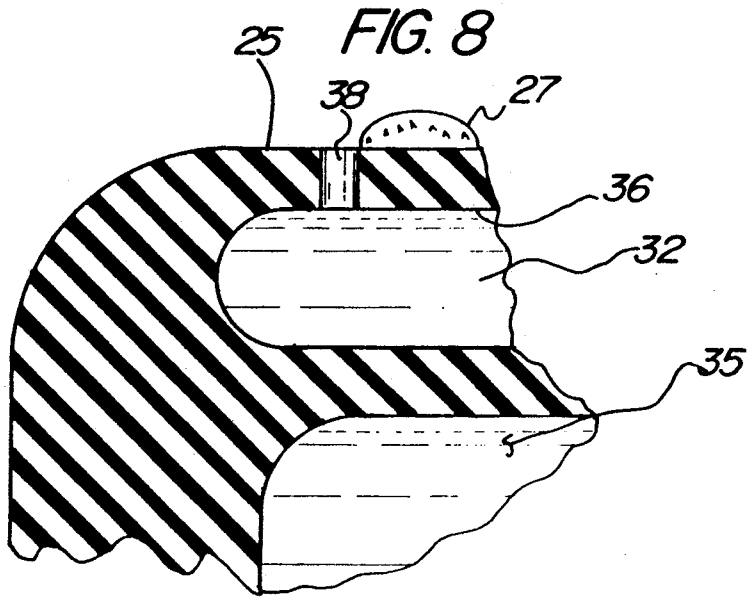
FIG. 8 is an enlarged orthographic view of section 8 as set forth in FIG. 7.

With reference now to the drawings, and in particular to FIGS. 1 to 8 thereof, a new and improved infant teething arrangement embodying the principles and concepts of the present invention and generally designated by the reference numeral 10 will be described.

More specifically, the infant teething arrangement 10 of the instant invention essentially comprises an elongate handle 11 having symmetrically oriented about a handle axis 15, having a first end fixedly mounting a first teething member 12 thereon, with the first teething member longitudinally aligned relative to the handle axis 15, and includes a resilient shape retentive abutment flange 16 at an interface of the elongate handle 11 and the first teething member 12, with the abutment flange 16 orthogonally oriented relative to the handle axis 15. A second teething member 13 is fixedly mounted to a second end of the handle 11, with the second teething member 13 of a cylindrical construction symmetrically oriented about a second teething member axis 14 orthogonally oriented relative to the handle axis 15.

The first teething member 12 is formed of respective first and second resilient plates 18 and 19 orthogonally bisecting each other and longitudinally aligned relative to and medially intersected by the handle axis 15. The first and second plates 18 and 19 have respective arcuate first and second side walls 20 and 21, and respective arcuate first and second end walls 22 and 23 to avoid any sharp edges to prevent damage to an infant projecting the first teething member into the infant's oral region.

The second teething member 13 of a cylindrical construction includes a cylindrical side wall 24 having planar parallel top and bottom walls 25 and 26, with a central opening 26*a* directed orthogonally and coaxially of the top and bottom walls. Further it should be noted that the top and bottom walls 25 and 26 each include a matrix of semi-spherical projections 27 mounted fixedly thereon of resilient construction, having resilient tips 28 to enhance the soothing and massaging of an infant's gums as the infant orally introduces the second teething member 13 during a massaging of the gums.

The FIGS. 5–8 indicates the organization including a modified handle 11*a* cooperative with a modified second teething member 13*a*. The handle 11*a* includes a fluid reservoir 29 medially thereof, including a fill cap 30 secured to the reservoir 29 permitting introduction of a fluid 32 into the reservoir. The fluid 32 may be either of a medicant to enhance soothing of an infant's gums or a consumable liquid to promote use of the second teething member by the infant and for prolonged periods of time to assist in the teething procedure. The fluid reservoir 29 is in fluid communication with a handle conduit 33 directed through the handle 11*a* into communication with the modified second teething member 13*a*. A check valve 31 is positioned within the handle conduit 33 adjacent the fluid reservoir 29 permitting fluid flow from the reservoir 29 to the handle conduit 33 only. The FIG. 7 indicates the modified second teething member 13*a* having a central enclosed fluid chamber 34 having water 35 for chilling purposes to further soothe an infant's gums or a selected compressible fluid may be employed and substituted for the water to provide for added resiliency to the second teething member body in use.

The top wall 25 has a top wall fluid chamber 36 coextensive and parallel to the top wall between the top wall and the central fluid chamber 34, with the bottom wall 26 having a bottom wall fluid chamber 37 coextensively oriented between the bottom wall and the central fluid chamber 34. It should be noted that the central fluid chamber 34 is typically of a cylindrical construction contained within the second teething member coextensively between the top and bottom walls in surrounding relationship relative to the opening 26*a*. The communication between the top and bottom wall fluid chambers 36 and 37 and respective top and bottom walls 25 and 26 is effected by communicating first and second weep hole ports 38 and 38*a* respectively relative to the top and bottom walls and the respective top and bottom wall fluid chambers 36 and 37 to permit seepage of fluid from the respective top and bottom wall fluid chambers 36 and 37 for coating the top and bottom walls and for oral ingestion and application of an infant's gums during the teething procedure.

It should be further noted that the central opening 26*a* is for use by an infant in assisting in grasping of the organization but may be eliminated and accordingly, the fluid chambers 34, 36 and 37 may be coextensively oriented within the side wall structure 24.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant teething arrangement, comprising, an elongate handle symmetrically oriented about a handle axis, with the handle having a first end and a second end, and a first teething member fixedly mounted to the first end longitudinally aligned with the handle and the handle axis, and a resilient abutment flange orthogonally oriented relative to the handle axis fixedly mounted to the first end at an interface of the handle and the first teething member, and the second end having a second teething member, with the second teething member of a cylindrical construction symmetrically oriented about a second teething member axis, with the second teething member axis orthogonally oriented relative to the handle axis, with the first teething member and the second teething member formed of resilient shape retentive materials, and the first teething member includes a first resilient plate orthogonally bisecting a second resilient plate, and the first resilient plate and the second resilient plate are longitudinally aligned with and bisected by the handle axis, and the first resilient plate includes spaced arcuate first side walls and an arcuate first end wall, and the second resilient plate includes spaced arcuate second side walls and an arcuate second end wall.

2. An infant teething arrangement as set forth in claim 1 wherein the second teething member includes a cylindrical side wall, a top wall, and a bottom wall parallel to the top wall and coextensive therewith, and the top wall and the bottom wall each include a plurality of semi-spherical projections, and each of the projections include resilient tips for enhancing massage of an infant's gums.

3. An infant teething arrangement as set forth in claim 3 including a central opening orthogonally directed through the second teething member with the central opening orthogonally oriented relative to the top wall and the bottom wall to enhance ease of grasping of the second teething member by said infant.

4. An infant teething arrangement as set forth in claim 3 wherein the elongate handle includes a fluid reservoir, the fluid reservoir having a fill cap permitting replenishment of the fluid reservoir, with an adjustable fluid, and the handle having a handle conduit in fluid communication with the fluid reservoir, and extending from the fluid reservoir to the second teething member, and a check valve mounted within the handle conduit permitting one-way flow of the fluid from the fluid reservoir to the second teething member, and the second teething member having a top wall fluid chamber coextensive with and in adjacency to the top wall and in fluid communication with the handle conduit, and a bottom wall fluid chamber coextensive with and adjacent the bottom wall in fluid communication with the handle conduit, and the top wall includes first weep hole ports in fluid communication between the top wall and the top wall fluid chamber, and the bottom wall having bottom wall weep hole ports in fluid communication between the bottom wall and the bottom wall fluid chamber.

5. An infant teething arrangement as set forth in claim 4 including a central enclosed fluid chamber positioned between the top wall fluid chamber and the bottom wall fluid chamber, having a fluid therewithin permitting chilling of the second teething member.

* * * * *